United States Patent [19]

Shaffstall

[11] Patent Number: 4,676,341

[45] Date of Patent: Jun. 30, 1987

[54] ADJUSTABLE ROOF SCAFFOLD JACK

[76] Inventor: Maurice Shaffstall, 1435 West Ave., H-9, Lancaster, Calif. 93534

[21] Appl. No.: 887,193

[22] Filed: Jul. 21, 1986

[51] Int. Cl.[4] ..... E04G 3/14

[52] U.S. Cl. ..... 182/45; 182/82; 182/178

[58] Field of Search ..... 182/45, 179, 178, 82; 248/237, 235

[56] References Cited

U.S. PATENT DOCUMENTS

| | | | |
|---|---|---|---|
| 429,427 | 6/1890 | Dearborn | 182/45 |
| 742,565 | 10/1903 | Berry | 182/45 |
| 1,142,694 | 6/1915 | Gilbert | 248/237 |
| 1,226,169 | 5/1917 | Bauer | 248/237 |
| 1,452,717 | 4/1923 | Wertz | 182/45 |
| 1,599,209 | 9/1926 | Cashman | 248/237 |
| 2,729,517 | 1/1956 | Hamilton | 248/237 |
| 3,082,843 | 3/1963 | Leonard | 182/178 |
| 3,164,353 | 1/1965 | Rene | 182/45 |
| 4,342,374 | 8/1982 | Montana | 182/45 |

FOREIGN PATENT DOCUMENTS

| | | | |
|---|---|---|---|
| 117066 | 8/1984 | European Pat. Off. | 182/45 |
| 2127081 | 4/1984 | United Kingdom | 182/45 |

*Primary Examiner*—Reinaldo P. Machado
*Attorney, Agent, or Firm*—Harlan P. Huebner

[57] ABSTRACT

An adjustable roof scaffold jack means for mounting on a pitched roof that includes adjustment means coupled to a support member adapted to be leveled to the horizontal for receiving a platform for workman to use in working on a vertical or angular surface adjacent to said pitched roof. The means include a base for mounting on the roof and a hinged support member with the adjustment means extending therebetween. The jack means when used with additional jack means forming a base for receiving platforms and conventional scaffold means which are tied together to present a safe area for receiving platforms for workmen to stand on.

6 Claims, 8 Drawing Figures

ADJUSTABLE ROOF SCAFFOLD JACK

BACKGROUND OF THE INVENTION

1. Field of the invention.

This invention relates to adjustable roof scaffold jacks used in the construction industry.

2. Description to the prior art

In the construction of a house or other building it is sometimes necessary to work on a vertical wall such as to lath or plaster the same while endeavoring to stand on a pitched roof adjacent the wall.

If the pitch of the roof is steep then there is danger to the worker should he stand on the roof and work on the wall.

In addition in some cases the vertical wall may be higher than the worker can reach without aid of some form of scaffolding.

In the past about the only way in which such work has been practical is to build some form of a wooden scaffold base to reduce the pitch to as horizontal a frame base as possible. In view of the need to use wood of varying size to shim and build up a platform support the supports have not always been horizontal or on the same plane. Such irregularities can cause platform irregularities when laid on such bases. These irregularities have caused accidents.

With the advent of Occupational Hazard and Safety Agencies (OSHA) both Federally and in states safety, is becoming more important, particularly in the building industry. Such irregular wooden platform bases certainly do not do anything to really increase safety.

Further, no prior art bases have heretofore been adjustable to the horizontal depending upon the pitch of the roof.

SUMMARY OF THE INVENTION

It is a purpose of the present invention to provide adjustable roof scaffold jacks which may be mounted on a pitched roof and adjust the same in such a manner that there are support bars which are horizontal and adapted to receive platforms there between for workmen.

Another object of the present invention is to provide an adjustable roof scaffold jack that is made of metal and includes a base member which can be nailed or otherwise secured to the roof and a telescoping support bar or adjustment means extending therefrom to the platform support member so that said member may be adjusted to the horizontal relative to the angle of the roof.

A still further object of the present invention is to provide an adjustable roof scaffold jack which includes means for receiving a conventional scaffold frame and when a series of scaffold jacks are used a conventional scaffolding made from the frames can be erected.

Another object to the present invention is to provide an adjustable roof scaffold jack which is relatively inexpensive to manufacture and easy to install by a person on a pitched roof adjacent to a vertical wall to be worked upon.

These and other objects and advantages will become apparent from the following part of the specification wherein details have been described for the confidence of disclosure, without intending to limit the scope of the invention which is set forth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
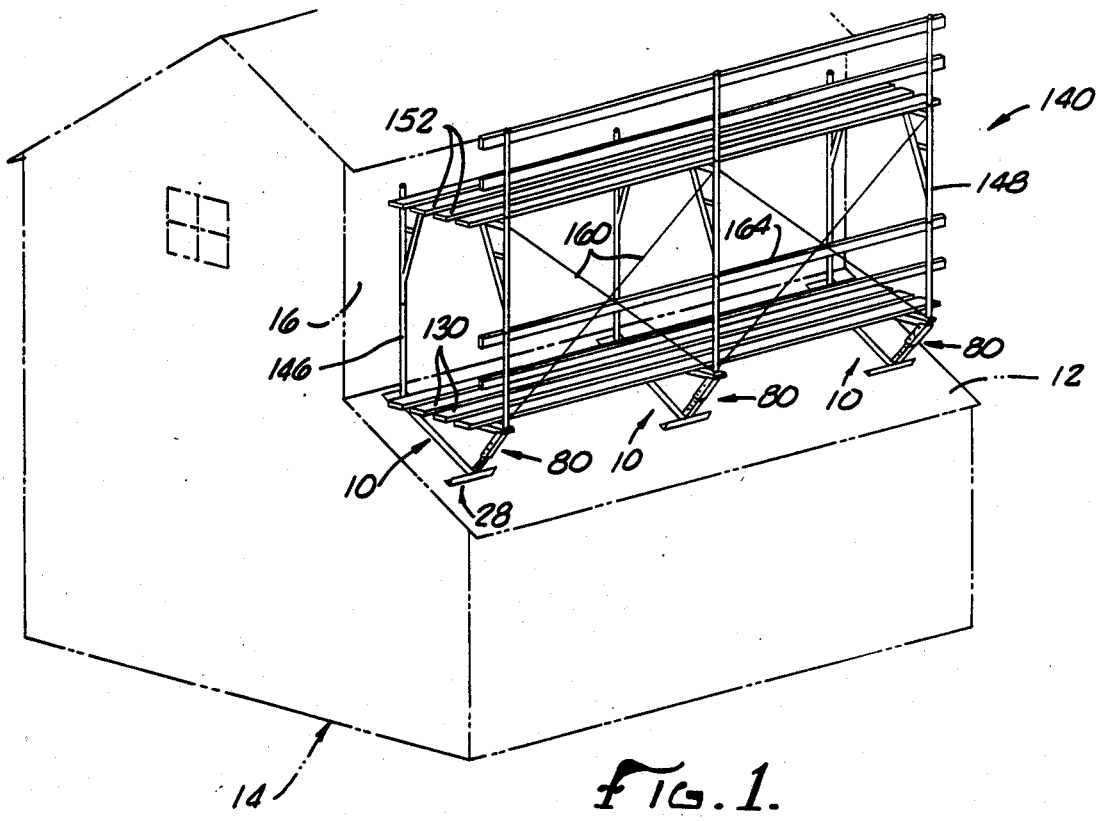
FIG. 1 is an environmental prospective view of several adjustable roof scaffold jacks mounted upon an angled or pitched roof adjacent to a vertical wall of a building.

In FIG. 1 there is illustrated a plurality of adjustable roof scaffold jack means generally designated 10 mounted upon an angled or pitched roof section 12 of a building generally designated 14. The purpose of the adjustable roof scaffold jack means 10 are to affix the same to the angled roof section 12 adjacent to a vertical wall 16 of the building 14. The purpose, of course, is to allow a workman to lath and plaster the vertical wall 16 and/or to paint the same or to perform other jobs thereon.

By use of adjustable roof scaffold jack means 10 spaced along the length of the roof 12, preferable 10 foot apart, a support means may be created whereby a platform may be laid thereon for the workman adjacent to the vertical wall 16.

In general, an adjustable roof scaffold jack means 10 includes a base member generally designated 18, as best seen in FIGS. 1, 2, 3 and 6. The base member 18 includes an elongated T shaped channel member of steel or other appropriate material with a top plate 20 and an elongated vertical leg 22 extending normal to the plane of the top plate 20 and of the same length. The base member 18 is elongated and includes a lower end 24 and an upper end 26.

Figure 3:
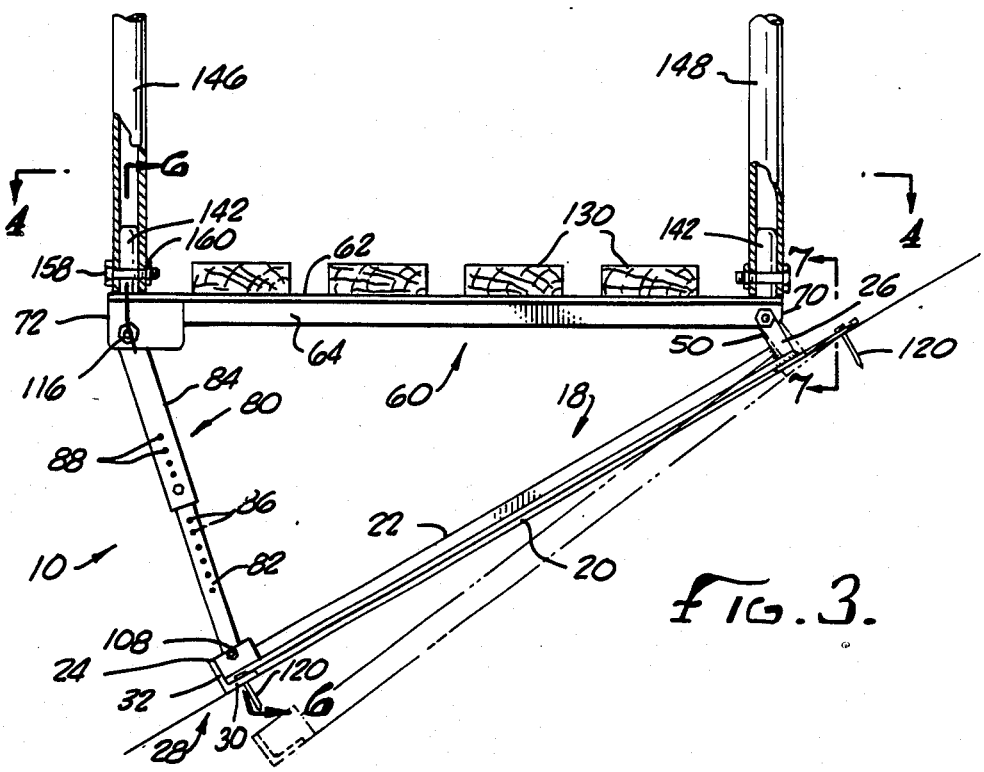
FIG. 3 is an enlarged detail side elevational view of a single adjustable roof scaffold jack mounted to a roof.
Figure 4:
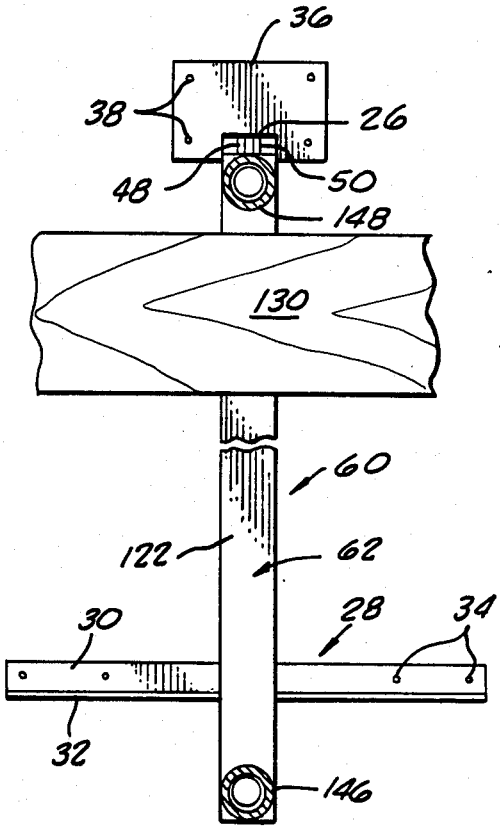
FIG. 4 is a top elevational view of a single adjustable roof scaffold jack as it would be mounted upon a roof.

Adjacent the lower end 24 of the base member 18 is a stabilizing means generally designated 28 which may also be an L angle iron, best seen in FIG. 3 and 4, having a base leg 30 and vertical leg 32 normal to the base leg 30. The base leg 30 of the stabilizing bar 28 includes a plurality of holes 34 extending therethrough to receive nails 120 for affixing the stabilizing leg and the adjustable roof scaffold jack means 10 to the roof 12.

At the forward end or upper end 26 of the base member 18 the means 28 includes a stabilizing fastening plate 36 which is welded or otherwise secured to the base member 18, as best seen in FIG. 4. The fastening plate 36 includes a plurality of holes 38 to receive fastening means 120 to nail or secure the entire base member 18 to the roof 12.

The stabilizing bar 28 is generally longer than the stabilizing fastening plate 36 and between both of these elements the frame member or jack means may be stabilized.

Figure 7:
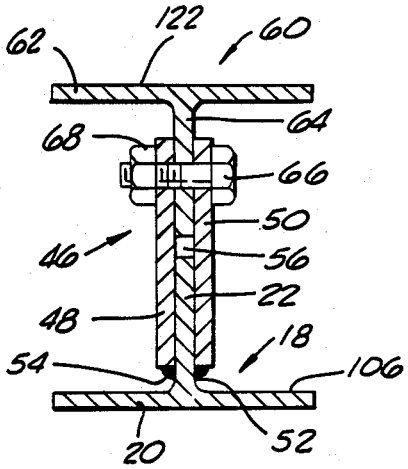
FIG. 7 is a cross sectional view of the front or upper pivot portion in the present invention taken on line 7—7 of FIG. 3.

At the forward or upper end 26 of the base member 18 is a pivot member generally designated 46, best seen in FIG. 7, which includes a pair of pivot bracket legs 48 and 50 welded as at 52 and 54 to the sides of the elongated vertical leg 22 of the base member 18.

Positioned in the space 56 between the pivot bracket legs 52 and 54 for pivotal movement is a platform support member generally designated 60. The platform support member 60 preferably is also an inverted T shaped channel member of steel or other appropriate material. The member 60 includes an elongated top plate 62 to support a platform and a downwardly extending elongated vertical leg 64 of the "T" which is centrally located on the plate 62 and extends the entire length of the elongated top plate 62.

The vertical leg 64 is of a thichness that is will interfit within the space 56 between the pivot bracket legs 48 and 50.

The leg 64 is pivotally secured to the pivot bracket legs 48 and 50 by means of a bolt 66 which passes through the legs 50, 64 and 48 and the assembly is held together by a nut 68 threadably secured on the bolt 66. In this way the platform support member 60 may be pivoted toward or away from the base member 18 which is vertically aligned below the platform support member 60.

The platform support member 60 has a front or upper end 70 and a rear or lower end 72.

In order to make the adjustable roof scaffold jack means 10 adjustable there is provided adjustment menas 80 which extend between the base member 18 and platform support member 60.

Figure 8:
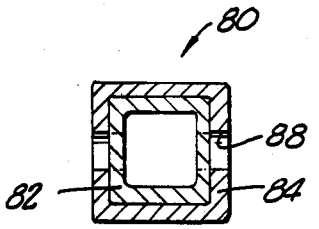
FIG. 8 is a cross sectional view of the telescoping member adjustable means taken on lines 8—8 of FIG. 6.

The preferred embodiment of the adjustment means 80 is a pair of telescoping members 82 and 84 preferably made of square bar stock such as illustrated in FIG. 8. As can be seen the member 82 of a lesser rectangular cross section will fit within the member 84 of a greater rectangular cross section. In that way the member 82 will slide in and out of the larger cross sectional member 84 to assure proper adjustment of the support platform member 60 to the horizontal relative to the angle of the base member 18 which is attached to a pitched roof.

The telescoping legs 82 and 84 have a plurality of adjustment setting holes 86 and 88 respectively to assure correct positioning of the platform support member 60. A bolt 90 may pass through openings 86 and 88 and a nut 92 will hold the bolt and in turn the telescoping support member 82 and 84 in position.

Figure 6:
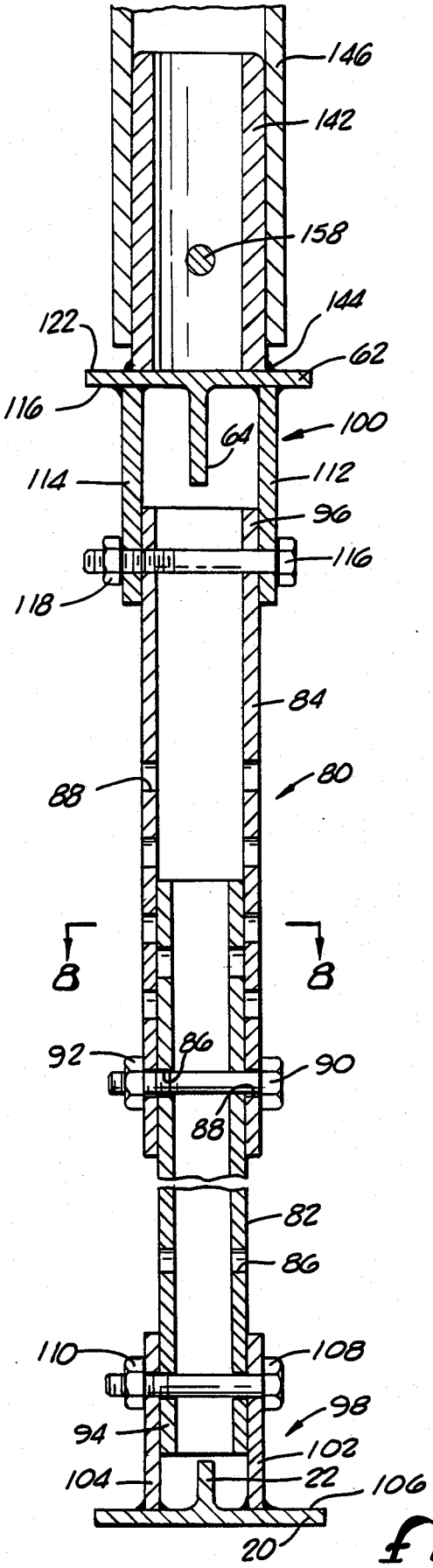
FIG. 6 is a view of the adjustment telescoping means of the present invention taken on lines 6—6 of FIG. 3.

In order to secure the ends 94 and 96, see FIG. 6, of the respective legs 82 and 84 there are a pair of lower and upper pivot bracket means 98 and 100 respectively. The lower pivot bracket means 98 includes a pair of spaced apart pivot mounting plates 102 and 104 which are welded to the upper surface 106 of top plate 20 and project toward the platform support member 60. In addition the height of the mounting plates 102 and 104 is greater than the height of the vertical leg 22.

The lower telescoping member 82 will be interfitted between the pivot mounting plates 102 and 104 and pivotally secured thereto by means of bolt 108 and nut 110.

At the platform support member 60, see FIG. 6, the upper pivot bracket means 100 includes a pair of spaced apart pivot mounting plates 112 and 114 which extend downward from the undersurface 116 of the top plate 62 and are welded thereto. The height of the respective pivot mounting plates 112 and 114 is greater than the height of the vertical leg 64.

The upper telescoping member 84 will be interfitted between the mounting plates 112 and 114 and pivotally secured thereto by means of bolt 116 and nut 118.

Thus, after the base member 18 is nailed to the roof 12 by nails 120, the bolt 90 is removed from the telescoping members 82 and 84 and the platform support means 60 can be pivotally raised or lowered so that the upper support surface 122 of elongated top plate 62 is horizontal or relatively horizontal.

With a plurality of adjustable roof scaffold jack means 10 positioned on the roof 12 then a platform for workmen may be formed thereon by use of material such as 2"×6" wooden planks 130 extending therebetween. For safety sake and due to construction of scaffolding generally designated 140 it is preferred to utilize the jack means 10 at approximately 10 feet intervals.

With the planks 130 in position on the surface 122 of respective jack means 10 a workman may then stand thereon to work on the vertical wall 16.

Figure 2:
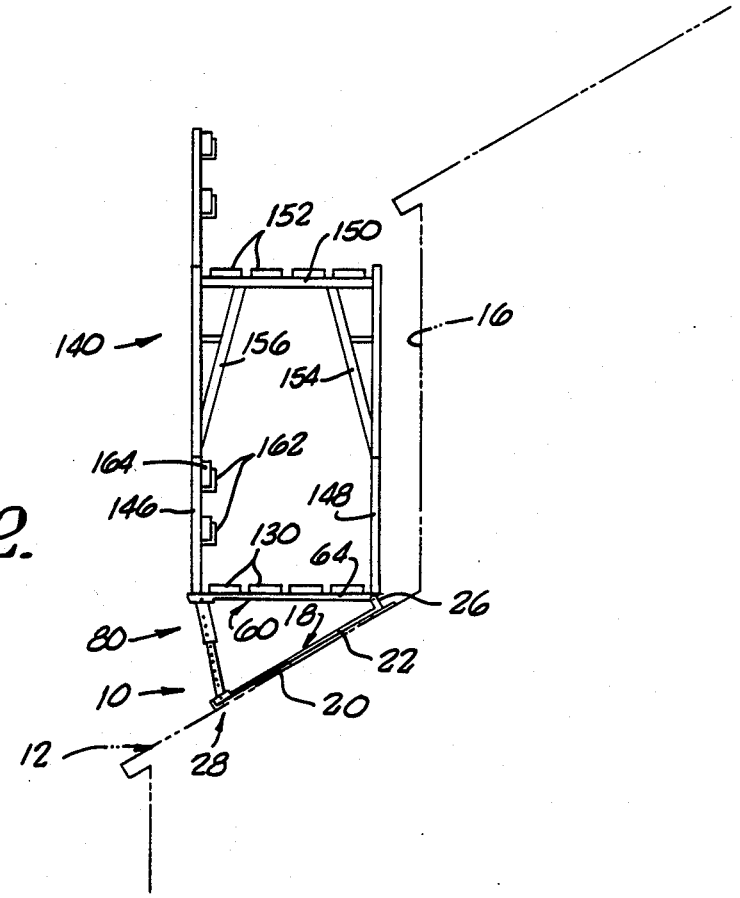
FIG. 2 is a side elevational view of the present invention as it would be mounted upon a building.

Because of the fact that the vertical wall 16 of the building 14 may be of a height greater than the reach of workman working thereon, conventional sectional scaffolding 140 may be employed. Such scaffolding is best seen in FIGS. 1 and 2.

In order to mount the scaffolding frame 140 on the individual jack means 10 there are provided a pair of scaffold receiving plugs 142 which are welded at 144 to upper support surface 122 of the platform support means 60, as best seen in FIGS. 3 and 6. The plugs are preferably round in cross section as the vertical legs 146 and 148 forming a part of the conventional scaffolding frame 140 are round. The frame also includes an upper support bar 150 extending between the legs 146 and 148 to receive additional platform material such as 2"×6" planks 152. The frame 140 includes support struts 154 and 156 extending from the legs 146 and 148 to support bar 150.

Preferably the plugs 142 are spaced 3 feet apart on surface 122 as the conventional scaffolding frames 140 have 3 feet centers. Each frame 140 is mounted in the plugs 142 and bolts 158 may pass through the leg 146 and plug 142 and are held in position by nut 160.

As best seen in FIG. 1 bracket members 160 may extend between the frames 140 to tie the scaffolding together. In addition, most scaffolding include guard rails holders 162 on the legs 146 to receive wood or other material guard rails 164 to prevent a workman from falling off of the platform.

Figure 5:
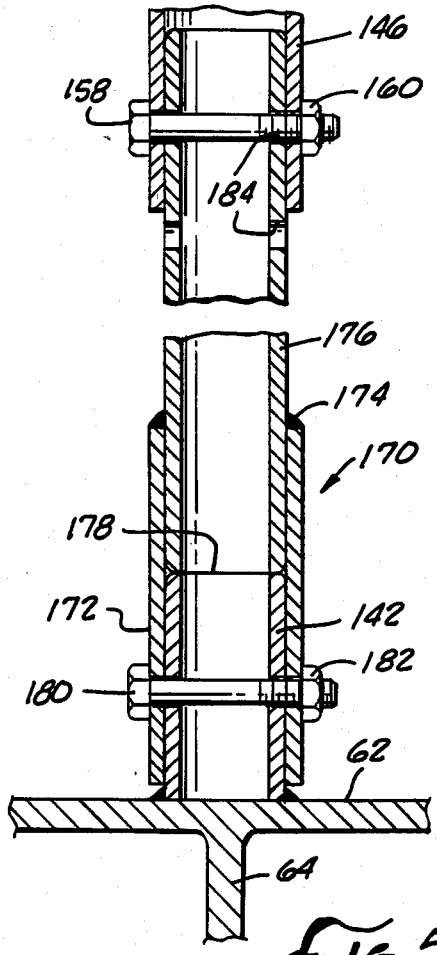
FIG. 5 is an enlarged cross sectional view of an extension leg means which may be mounted on the adjustable roof scaffold jack to assure proper leveling of a scaffolding frame which is adapted to be mounted on the adjustable roof scaffold jack.

In FIG. 5 there is illustrated a scaffold extension leg generally designated 170. The extension leg 170 includes a sleeve 172 which is adopted to slide over the scaffold frame plug 142. To the sleeve 172 is welded at 174 an inner tubular sleeve or extension plug 176 having a bottom end 178 which butts the top of the plug 142.

The sleeve 172 is secured to the plug 142 by means of bolt 180 passing through the sleeve 172 and plug 142 and held in place by nut 182.

The inner sleeve or extension plug 176 includes a plurality of adjustment holes 184 passing therethrough. After the scaffold extension leg is positioned, the leg 146 or 148 of the scaffold frame 140 slides over the inner sleeve 176 to an appropriate hole 184. The bolt 158 is then passed through and maintained by nut 160.

By having a number of adjustment holes 184 the frames 140 can be adjusted to relatively exacting heights. This is particularly important when the upper support bar 150 of the scaffold frame 140 is to have a platform for use by workman.

The invention and its attendant advantages will be understood from the foregoing description and it will be apparent that various changes may be made in the form, construction and arrangement of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. An adjustable roof scaffold jack means for positioning on a pitched roof of a building, which jack means is capable of presenting a horizontal surface adapted to receive a portion of a platform for workmen to work on an area of said building comprising:

an elongated inverted T shaped base member in cross section having an upper end and a lower end and being capable of affixation to a roof, said leg of said inverted T being of a height less than the width of the top of said T;

an elongated T shaped supporting member in cross section wherein the top of said T forms a surface to receive a platform and said leg of said T is of a height less than the width of said top of the T yet greater than the height of said leg of said base member and said supporting member is pivotally connected to said base member;

adjustment means in the form of telescoping members one within the other, whereby one is secured in end wise position on the platform supporting member and one is secured in end wise position on the base member, and a plurality of adjustment holes in each member and pin means insertable therethrough to fix the elevation of said platform supporting member;

pivot means including a pair of spaced apart side plates secured to either side of said leg of said base member and said side plates extend higher than the height of said leg of said T wherein said leg of said T of said supporting member is interfitted therebetween and a pivot pin passes therethrough;

stabilizer means affixed to the top of said T of said base member and projecting outwarldy of said base member wherein there is a first plate member at the upper end of said base member on each side of said base member of a length greater than the width of said base member and a second plate member at the lower end of said base member projecting on each side of said base member of a length greater than the length of said first plate member and each of said plate members adopted to be secured to said roof.

2. An adjustment roof scaffold jack means as defined in claims 1 wherein said plate members include:

nail holes therein adopted to receive nails to fasten said plates to said roof; and said second plate member is an angle iron.

3. An adjustable roof scaffold jack means as defined in claim 2 wherein there is included scaffold frame receiving means which are scaffold frame plugs over which legs of a scaffold frame are inserted.

4. An adjustable roof scaffold jack means as defined in claim 2 wherein there are a plurality of said jack means spaced along said pitched roof whereby a platform may be positioned on said platform supporting members and extending therebetween for use by workmen.

5. An adjustable roof scaffold jack means as defined in claim 3 wherein there is included:

scaffold extension leg means secured to said scaffold frame receiving means whereby said frame may be adjusted separately from the adjustment of said jack means for greater precision adjustment.

6. An adjustable roof scaffold jack means as defined in claim 5 wherein said scaffold extension leg includes:

a sleeve adapted to surround said scaffold frame plug;

an extension plug secured within said sleeve and projecting outwardly of said scaffold frame plug, and having a plurality of adjustment holes therein, said extension plug being adopted to also receive one of said legs of said scaffold frame; and locking means to maintain said leg to said extension plug.

* * * * *